United States Patent [19]

Melton et al.

[11] 4,386,971

[45] Jun. 7, 1983

[54] PROCESS FOR MANUFACTURING A FINISHED COMPONENT FROM AN NI/TI OR NI/TI/CU MEMORY ALLOY

[75] Inventors: Keith Melton, Busslingen; Olivier Mercier, Ennetbaden; Günther Schröder, Birmenstorf, all of Switzerland

[73] Assignee: BBC Brown, Boveri & Company, Limited, Baden, Switzerland

[21] Appl. No.: 354,358

[22] Filed: Mar. 3, 1982

[30] Foreign Application Priority Data

Mar. 13, 1981 [CH] Switzerland ..... 1729/81

[51] Int. Cl.[3] ..... C22F 1/00; C22F 1/10

[52] U.S. Cl. ..... 148/11.5 R; 148/11.5 N

[58] Field of Search ..... 148/11.5 N, 11.5 F, 148/11.5 R

[56] References Cited

U.S. PATENT DOCUMENTS

| | | | |
|---|---|---|---|
| 3,652,969 | 3/1972 | Willson et al. | 148/11.5 N |
| 3,953,253 | 4/1976 | Clark | 148/11.5 F |
| 4,144,057 | 3/1979 | Melton et al. | 148/11.5 N |
| 4,149,911 | 4/1979 | Clabburn | 148/11.5 N |
| 4,304,613 | 12/1981 | Wang et al. | 148/11.5 N |

*Primary Examiner*—W. Stallard

*Attorney, Agent, or Firm*—Oblon, Fisher, Spivak, McClelland & Maier

[57] ABSTRACT

Finished components made from Ni/Ti or Ni/Ti/Cu memory alloys can be manufactured by isothermal or quasi-isothermal ("hot die") working of sections of semifinished product, and by subsequent additional cold-working in the temperature region of the martensitic transformation by flow-turning, tapering, necking, ironing or spinning, it being possible to dispense, completely or at least to a large extent, with an additional machining operation of the metal-cutting type. Manufacture of complicated connecting elements, using the memory effect, for connecting rods, tubes, plates, etc.

10 Claims, 13 Drawing Figures

PROCESS FOR MANUFACTURING A FINISHED COMPONENT FROM AN NI/TI OR NI/TI/CU MEMORY ALLOY

BACKGROUND OF THE INVENTION

1. Field of the Invention:

This invention relates to a process for manufacturing a finished component from a memory alloy.

2. Description of the Prior Art:

Shaped memory alloys of the Ni/Ti type, and their properties, are known from the literature (e.g. C. M. Jackson, H. J. Wagner and R. J. Wasilewski, 55-Nitinol-The alloy with a memory: its physical metallurgy, properties and applications, NASA SP5110, pages 19–21).

In the manufacture of finished components from memory alloys based on nickel and titanium, processing starts, as a rule, from appropriately preshaped semifinished products, such as rod, tube, strip and sheet material. In principle, machining of the metal-cutting type can be employed to convert suitable sections of the selected starting material into the final product.

Attempts have certainly also been made to employ conventional hot-working methods for this purpose, such as die-forging, etc.

Having regard to the brittleness and hardness, and to the inadequate ductility of these alloys, cutting-type machining is unsuitable and uneconomical, especially for mass production. On the other hand, conventional hot-shaping processes have hitherto been unsuccessful, since very high deformation forces were needed in these processes, and the structure of the material was extensively destroyed in the course of the working operation. There is accordingly an outstanding need for the development of new, inexpensive processes, especially with regard to the very wide range of possible applications of finished components made from memory alloys as connecting elements.

SUMMARY OF THE INVENTION

The object underlying the invention is to specify a manufacturing process for Ni/Ti and Ni/Ti/Cu finished components, in particular connecting elements, this process being simple and economical, and guaranteeing a high accuracy of reproducibility with reference to the geometry and physical properties of the final product.

This object is achieved, according to the present invention, by a process for manufacturing a finished component from an Ni/Ti or Ni/Ti/Cu memory alloy which comprises processing semifinished product in the form of rod or wire, through several working steps, in the hot state and in the cold state, wherein a blank, in the form of a section of semifinished product, is initially subjected to a hot-working operation in the temperature range from 500° to 1,300° C. while simultaneously maintaining a die temperature within the temperature range of the blank and 250° C., and wherein a workpiece, which has been shaped in this way, is cooled and is subjected to a further cold-working operation, at a temperature below the martensitic transformation point.

BRIEF DESCRIPTION OF THE DRAWINGS

The invention is described in more detail with the aid of the illustrative embodiment which follows. A rough selection of the wide range of shapes which can be obtained when applying the process is represented in the figures, which are explained below.

In the figures.

DESCRIPTION OF THE PREFERRED EMBODIMENTS

Figure 1:
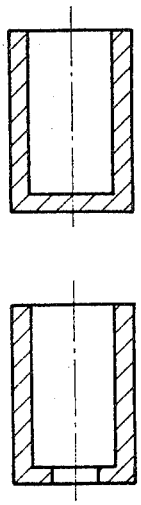
FIGS. 1 to 6 show relatively simple and relatively complicated connecting elements for rod-connections and tube-connections.
Figure 2:
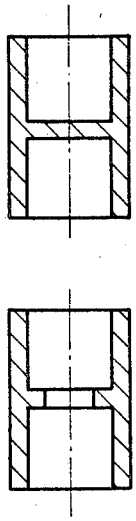
Figure 3:
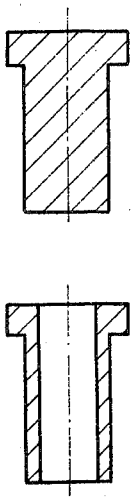
Figure 4:
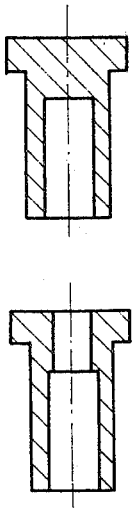
Figure 5:
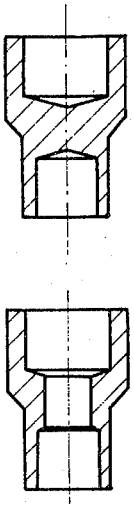

In the FIGS. 1 to 6, a number of illustrative embodiments of connecting elements are represented in longitudinal section, progressing from simple shapes to more complicated shapes. In these figures, the unperforated basic shape is shown in the upper half of the figure in question, while the derived shape, which has been perforated or drilled through, is shown in the lower half. FIG. 1 shows a cylindrical body, as used, for instance, as a tube-closing element, which must be pushed on from the outside, and which automatically contracts on being heated to above the temperature $A_F$ (end of the transformation into austenite). In an analogous manner, FIG. 2 relates to a rod/rod connection, a tube/tube connection, or a rod-tube connection. An element according to FIG. 3 can be used as a tube-closure in the outward direction (plug), or as a tube/plate connection, after it has been heated to above $A_F$ and has expanded as a result of this heating. FIG. 4 shows an element with a stop, which can be used, inter alia, as a tube-closure (upper half of the figure), or as a rod/rod connection (lower half of the figure). An element according to FIG. 5, made of memory alloy, serves to make rod/rod or tube/tube connections for components of different diameter, which are to be joined, the memory effect coming into operation by causing the element to contract in the radial direction.

Figure 6:
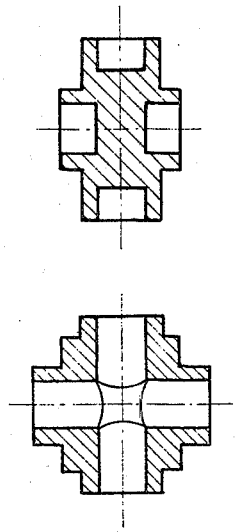

FIG. 6 relates to a connecting element for 4 rods or 4 tubes, it being possible to apply the memory effect, in the first case, by contraction along, and, in the second case, both by contraction and by expansion.

Figure 7:
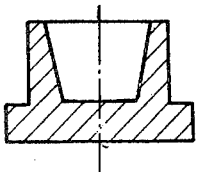
FIGS. 7 to 12 show relatively complicated special-purpose connecting elements for rod connections, tube connections and plate-connections.
Figure 8:
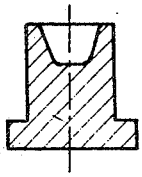
Figure 9:
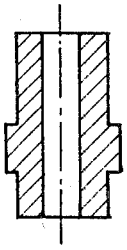
Figure 10:
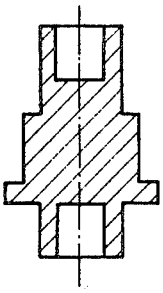
Figure 11:
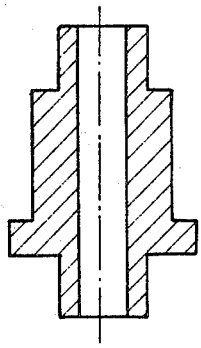
Figure 12:
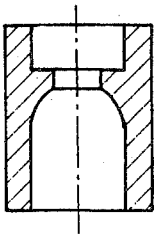

FIGS. 7 to 12 show special-purpose connecting elements with complicated shapes, which are intended to illustrate the degree of change of shape up to which the process according to the invention can be applied. FIG. 7 represents an element with a stop, this element being intended to be used as a tube-closure, internally, that is to say as an expanding element. In order to allow for elasticity and the decay of the internal stresses, as well as for the notch effect, this element possesses a projecting portion, which is cylindrical on the outside and which runs conically on the inside, with a tapering wall thickness. FIG. 8 shows a similar element, but this element has an additional central portion, which is cylindrical and is designed as a solid body. It is particularly suitable for plate/plate connections, in place of rivets or screws. The element according to FIG. 9 can be used as a tube/tube connection, or as a tube/plate connection, while utilizing the radial expansion. FIG. 10 shows an element for a rod/plate connection. In this case, the central portion, in the form of a solid cylinder, which is to receive the plate, must act in the expansion mode, while the outward-projecting ends, which are in the form of hollow cylinders and are intended for the attachment of the rods, must, in contrast, act in the compression mode. However, it is also possible to make the rods, or the plate, from a memory alloy as well. In this case, the memory effect of the connecting element acts only in one direction. FIG. 11 represents a tube/plate connecting element which acts (expansively) only in one direction. FIG. 12 shows a special-purpose connecting element for a relieved (diameter-reduction) tube/tube connection, this element being designed in a manner which is advantageous in terms of fluid mechanics.

It is self-evident that the application of the invention is not restricted to the production of the shapes of element described above. Virtually all types of connecting elements can be manufactured by means of the isothermal or quasi-isothermal ("hot die") process. In particular, the process is in no way restricted to shapes having a circular cross-section. The cross-section can just as well be designed to be elliptical, triangular, square, rectangular, hexagonal, or octagonal.

Figure 13:
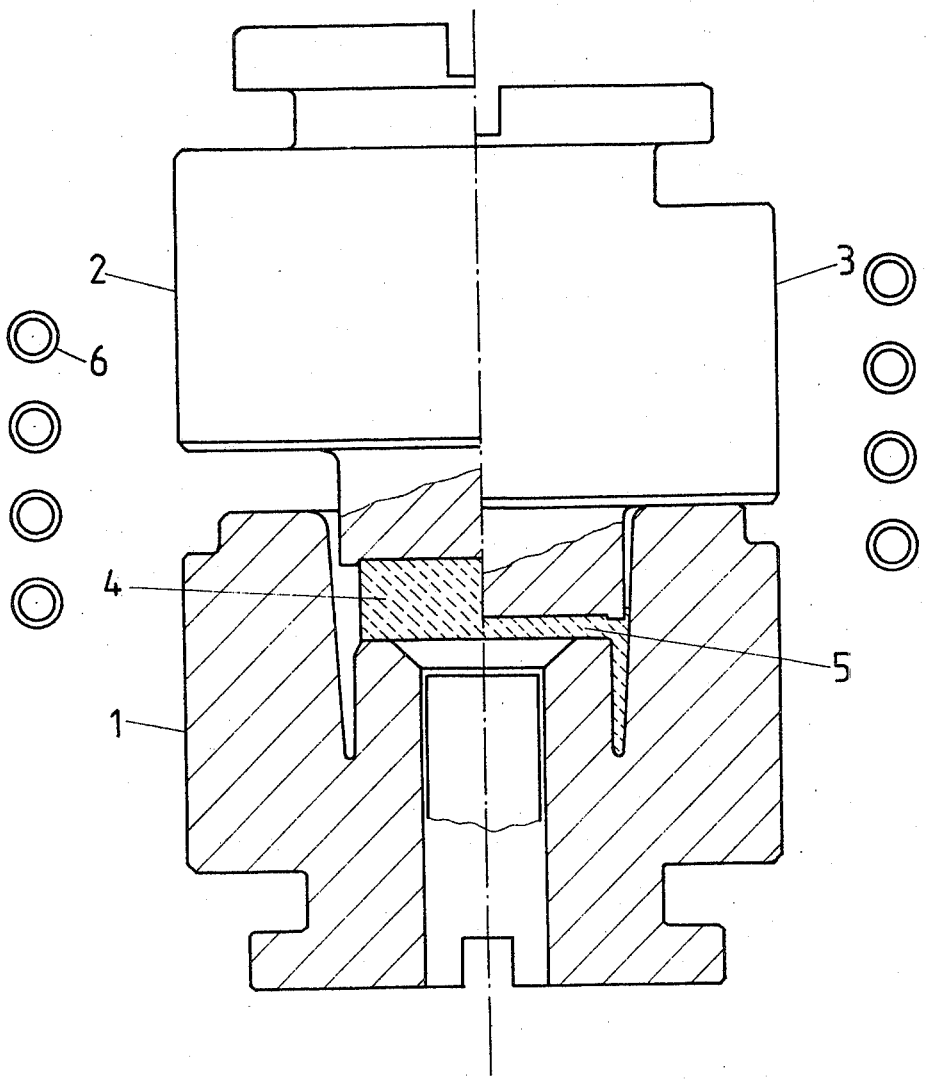
FIG. 13 shows an elevation and longitudinal section of a heated two-piece press-tool, including the workpiece, in order to explain the pressing operation.

In FIG. 13, the pressing operation is illustrated by reference to a heated pressing-die, including the workpiece, represented in elevation and longitudinal section. The figure is merely intended to show what shapes can still be realized by isothermal pressing, or pressing using "hot dies". 1 is the pressing-die (lower half of the die), 2 is the male die, in the starting position, and 3 is the male die at the end of the pressing operation. 4 represents a longitudinal section through the workpiece at the start of the pressing operation, that is to say, through the blank which is inserted into the die 1. 5 is a longitudinal section through the workpiece at the end of the pressing operation, that is to say through the finished component, which, in the present case, is a cap for a thyristor. The entire figure must be regarded as being rotationally symmetrical. 6 is an induction-type heating device.

EXAMPLE 1

Refer to FIG. 13.

Employing conventional metallurgical melting processes, a quaternary alloy with the following composition was manufactured:

Ti=44.25% by weight
Ni=47.75% by weight
Cu=5% by weight
Fe=3% by weight

The components, present in the elementary form, were purified, dried, and melted down, in vacuo, in a graphite crucible. In this operation, an initial melt of an alloy of the same composition, which had already been pre-melted, was present at the bottom of the crucible. The melt was cast into a cooled, conical copper mold. The cast bar, of truncated-conical shape, had a base diameter of 85 mm, a head diameter of 70 mm, and a height of 250 mm. The bar was subjected to a homogenizing annealing treatment, just below the solidus line, in the present case at a temperature of 1,100° C., for a period of 4 hours, under an argon atmosphere. Following this annealing treatment, the bar was subjected to thermomechanical processing, whereby it was initially worked, by pressing and forging, to a diameter of 45 mm, and was finally worked to produce a rod having a diameter of 20 mm. Circular disks, 8 mm thick and 19.5 mm in diameter, were machined from this rod, using a lathe.

One disk at a time was inserted, as the workpiece 4, into the pressing die 1 according to FIG. 13, and was worked, by pressing down the male die 2, to produce a finished component 5. In the present case, a cap for the holder of a semiconductor component was manufactured. The force on the male die was 150 kN, the average speed of the male die was 0.1 mm/sec, and the workpiece and die temperature was isothermal, at 950° C. In the present case, the workpiece, after deburring, was machined still more cleanly to the final dimensions by a metal-cutting method. An additional machining operation of this type is indicated in cases where accurate, closely-toleranced fits are required. However, this machining operation amounts only to a vanishingly small fraction of the machining of workpieces which, in contrast, had previously to be turned from solid rod material. In many cases, additional machining is superfluous.

The illustrative embodiment is intended to represent how the isothermal shaping process according to the invention can be employed for the economical manufacture of thin-walled workpieces with complicated shapes.

The process is not limited to the illustrative embodiment. Depending on the particular alloy and workpiece, it can be carried out in the temperature range from 500° to 1,300° C. At the same time, there is no absolute obligation to employ isothermal working (die temperature=workpiece temperature). In principle, the die can also be colder than the workpiece, but the temperature of the die should not be less than 250° C. However, the temperature difference between the workpiece and the die should not exceed 500° C. during the entire working operation. The hot-working operation for manufacturing the finished component can, in principle, be carried out by hot-pressing or hot-extruding.

The workpiece can possess a base or an internal partition, which is perforated, by means of a punching tool, or which is drilled, by means of a cutting tool, either in the cold state, or in the hot state, before the workpiece is cooled to below the martensitic transformation point.

After the shaping operation, the finished component is cooled and is subjected to a cold-working operation at a temperature below $M_S$ (point at which the martensitic transformation starts). This cold-working operation can comprise a reduction of the wall-thickness of the workpiece, by flow-turning or ironing, or a reduction of the external dimensions, by tapering, necking, or spinning. The cold-working operation can, additionally, be an enlargement of an external dimension, by spinning or bulge forming, or an enlargement of an internal dimension, by bulge forming.

We claim:

1. A process for manufacturing a finished component from an Ni/Ti or Ni/Ti/Cu memory alloy which comprises processing semifinished product in the form of rod or wire, through several working steps, in the hot state and in the cold state, wherein a blank, in the form of a section of semifinished product, is initially subjected to a hot-working operation in the temperature range from 500° to 1,300° C., while simultaneously maintaining a die temperature within the temperature range of the blank and 250° C., and wherein a workpiece, which has been shaped in this way, is cooled and is subjected to a further cold-working operation, at a temperature below the martensitic transformation point.

2. A process as claimed in claim 1, wherein the hot-working operation is carried out isothermally, at a constant workpiece and die temperature.

3. A process as claimed in claim 1, wherein the hot-working operation is carried out with a hot die, in such a manner that the temperature difference between the workpiece and the die does not exceed 500° C. during the entire working operation.

4. A process as claimed in claim 1, wherein the hot-working operation is a hot-pressing operation, or a hot-extrusion operation.

5. A process as claimed in claim 1, wherein the cold-working operation, which must be carried out below the martensitic transformation point, is a reduction of the wall thickness of the workpiece, by flow-turning, or by ironing.

6. A process as claimed in claim 1, wherein the cold-working operation, which must be carried out below the martensitic transformation point, is a reduction of an external dimension of the workpiece, by tapering, necking, or spinning.

7. A process as claimed in claim 1, wherein the cold-working operation, which must be carried out below the martensitic transformation point, is an enlargement of an external dimension, by spinning or bulge forming.

8. A process as claimed in claim 1, wherein the cold-working operation, which must be carried out below the martensitic transformation point, is an enlargement of an internal dimension, by bulge forming.

9. A process as claimed in claim 1, wherein the workpiece possesses a base or an internal partition, which is perforated, by means of a punching tool, or which is drilled, by means of a cutting tool, in the cold state, or in the hot state, before the workpiece is cooled to below the martensitic transformation point.

10. A process as claimed in any one of claim 1 to claim 9, wherein a rotationally symmetrical connecting element is produced as the workpiece, said element having circular cross-sections.

* * * * *